US005289937A

United States Patent [19]

Boots

[11] Patent Number: 5,289,937

[45] Date of Patent: Mar. 1, 1994

[54] CONTAINER COMPRISING A RELATIVELY STIFF, FORM-RETAINING SUPPORTING FRAME AND A FLEXIBLE SHELL MEMBER ARRANGED THEREIN

[76] Inventor: Gerardus A. M. Boots, J. Kruyverstraat 26, 1507 WH Zaandam, Netherlands

[21] Appl. No.: 6,039

[22] Filed: Jan. 19, 1993

[30] Foreign Application Priority Data

Jan. 23, 1992 [NL] Netherlands ..... 9200130

[51] Int. Cl.[5] ..... B65D 19/36; B65D 90/04

[52] U.S. Cl. ..... 220/9.1; 220/401; 220/403; 220/668; 220/666; 383/104; 383/119

[58] Field of Search ..... 220/400, 401, 403, 408, 220/410, 666, 668, 9.1, 9.2, 1.5, 460, 461, 645, 647, 353; 383/104, 119; 206/586

[56] References Cited

U.S. PATENT DOCUMENTS

| | | | |
|---|---|---|---|
| 1,192,091 | 7/1916 | Miller | 220/9.1 |
| 1,642,643 | 9/1927 | Carruth | 220/9.1 |
| 4,390,051 | 6/1983 | Cuthbertson . | |
| 4,453,634 | 6/1984 | Blumenthal | 220/353 |
| 4,549,672 | 10/1985 | Rinkewich | 220/441 |
| 4,834,255 | 5/1989 | Boots | 220/410 |
| 4,901,885 | 2/1990 | Boots | 220/403 |
| 4,927,037 | 5/1990 | Boots | 220/403 |
| 5,025,925 | 6/1991 | Wiklund | 383/119 |
| 5,052,579 | 10/1991 | Boots | 220/401 |
| 5,071,025 | 12/1991 | Boots | 383/119 |

FOREIGN PATENT DOCUMENTS

| | | | |
|---|---|---|---|
| 476858 | 6/1976 | Australia . | |
| 0360730 | 3/1990 | European Pat. Off. . | |
| 0445895 | 9/1991 | European Pat. Off. . | |
| 2639037 | 5/1990 | France . | |
| WO89/09171 | 10/1989 | PCT Int'l Appl. . | |
| 182352 | 7/1922 | United Kingdom . | |
| 2240088 | 7/1991 | United Kingdom | 383/119 |

*Primary Examiner*—Allan N. Shoap
*Assistant Examiner*—S. Castellano

[57] ABSTRACT

The container comprises a relatively stiff, form-retaining supporting frame and a flexible shell member. The supporting frame comprises a polygonal bottom member and a corresponding cover member. Each angular point of the bottom member is connected with an angular point of the cover member by means of a rod-shaped element. The flexible shell member is connected with each rod-shaped element by means of a flexible loop member. Each loop member starts from a point of attachment to the shell member and passes around a rod-shaped element to a second point of attachment. The arrangement is such that the loop members keep the shell member within the outer boundaries of the supporting frame at all times, at least if the shell member contains goods to be packaged. According to the invention, a strip-shaped member made from a flexible material is connected with the shell member at the points of attachment. It has a length at least equal to that of a rod-shaped element and a width greater than that of the shell member between two points of attachment. The associated rod-shaped element extends between the loop member and the strip-shaped member.

12 Claims, 5 Drawing Sheets

CONTAINER COMPRISING A RELATIVELY STIFF, FORM-RETAINING SUPPORTING FRAME AND A FLEXIBLE SHELL MEMBER ARRANGED THEREIN

This invention relates to a container comprising a relatively stiff, form-retaining supporting frame and a flexible shell member arranged therein, this shell member forming a receiving space for substances, materials, goods and the like to be packaged, the supporting frame comprising a polygonal bottom member and a correspondingly shaped polygonal cover member, each angular point of the bottom member being connected with an angular point of the cover member by means of a rod-shaped element, the flexible shell member being connected with each rod-shaped element by means of a flexible loop member in that each loop member, starting from a point of attachment to the shell member, passes around a rod-shaped element and extends further to a second point of attachment to the shell member, spaced from the first point of attachment, the loop member having a length greater than a multiple of the circumference of the rod-shaped element, the arrangement being such that the loop members keep the shell member within the outer boundaries of the supporting frame at all times, at least if the shell member contains substances, materials, goods or the like to be packaged.

Such a container is disclosed in Dutch patent application 8801523, also in the name of the present inventor. As the shell-shaped member is filled, the loop members are subjected to tensile stress. As a result, the shell member is rendered substantially immovable in its position within the supporting frame. The supporting frame is subjected to an implosive load by the loop members under tensile stress. As a result, the container cannot have any bulging parts and accordingly possesses optimum stacking density.

It has been found in practice that the spaces located inside the supporting frame but outside the shell-shaped member, in particular the spaces within the loop members, cannot be used at all times, for instance if goods are to be packaged that are not to come into direct or indirect contact with the rod-shaped elements.

The object of the invention is to provide means that allow a higher degree of filling of the container of the type described in the preamble, also in the above-mentioned cases.

This is achieved according to the present invention in that a strip-shaped member made from a flexible material is connected with the shell member at or between the points where the loop member is attached to the shell member, this strip-shaped member having a length at least equal to that of a rod-shaped element and a width greater than that of the shell member as measured between the two points of attachment mentioned, with the associated rod-shaped element extending between the loop member and the strip-shaped member. By these features, an additional compartment is formed at the location of each loop member, which can be filled up in the same manner as the shell member and even at the same time as the shell member, because, owing to the strip-shaped member, the shell member can now, without any problem, be provided with interruptions between the two points where a loop-shaped member is attached to the shell member. Thus, as the shell member is filled, the additional compartments mentioned are filled at the same time.

If the packaged goods are to be prevented from coming into any direct as well as indirect contact with the rod-shaped elements, it is preferred, in accordance with a further embodiment of the invention, that the width of the strip-shaped member is equal to that of an arc of a circle, which, starting from a point of intersection of the shell member—forming one point of attachment of the loop member to the shell member—first touches the loop member, then extends along the rod-shaped element, touching it at most, and then, again touching the loop member, continues to a second point of intersection of the shell member, which forms the other point of attachment of the loop member to the shell member. Additional compartments thus formed have their own stability by virtue of the effects described and explained in European patent 247696, also in the name of the present inventor.

If only direct contact of the packaged goods with the rod-shaped elements is undesirable, a further increase of the degree of filling can be achieved when, in accordance with a further embodiment of the invention, the width of the strip-shaped part is substantially equal to that of the loop member. It has been found to be possible to fill the space surrounded by the loop member completely, partly because the loop member is subjected to tensile stress as the shell member is being filled, resulting in tubular additional compartments that are stable in themselves.

The flexible part of the container can be manufactured in a relatively simple manner, if the shell member, the loop members and the strip-shaped members are formed from three tubular parts, with wall portions of those tubular parts being in surface-to-surface contact with each other between a point of attachment of a first loop member and the adjacent point of attachment of a second loop member. The flexible part of the container as a whole can thus be readily closed if the tubular part that forms the strip-shaped members is so much longer than the rod-shaped elements that the tubular part mentioned can serve for a bottom and cover closure for the packaged substances, materials, goods and the like.

The container can have an outer circumference of both square and rectangular form in horizontal cross-section. Naturally, many other forms are possible, for instance hexagonal or octagonal forms.

If the container is desired to be rectangular, for forming the shell-shaped member, use can be made of the various configurations defined in Dutch patent application 9000552, also in the name of the present inventor. A number of these configurations are further elaborated in the appended claims 8–10.

The supporting frame can be made of any desired and suitable material. In Dutch patent application 8801523, for instance, a number of wooden supporting frames are shown. Another option is to use a metal supporting frame, in which case it is preferred that the cover member and the bottom member are each provided with a circumferential frame consisting of fixedly interconnected angle sections as well as coupling means for the rod-shaped elements, the arrangement being such that a space remains between the rod-shaped elements and the angle sections for inserting sidewall elements. In this manner, it is simple, even after the container has been filled and closed, to provide a casing affording protection of the flexible parts within the supporting frame. Such a casing, which is to be provided afterwards, moreover offers a wide variety of possibilities of providing imprints of texts, brandnames, logos, and the like.

In unfilled condition, the container can be collapsed into a packet occupying a minimum of space and, moreover, be rapidly set up when, in accordance with a further embodiment of the invention, the rod-shaped elements consist of tubular elements and the coupling means consist of pins mounted on the cover or bottom member and adapted to slidably extend into the tubular elements.

The container according to the invention will now be further described and explained, by way of example only, with reference to the embodiments shown in the accompanying drawings, in which.

Figure 1:
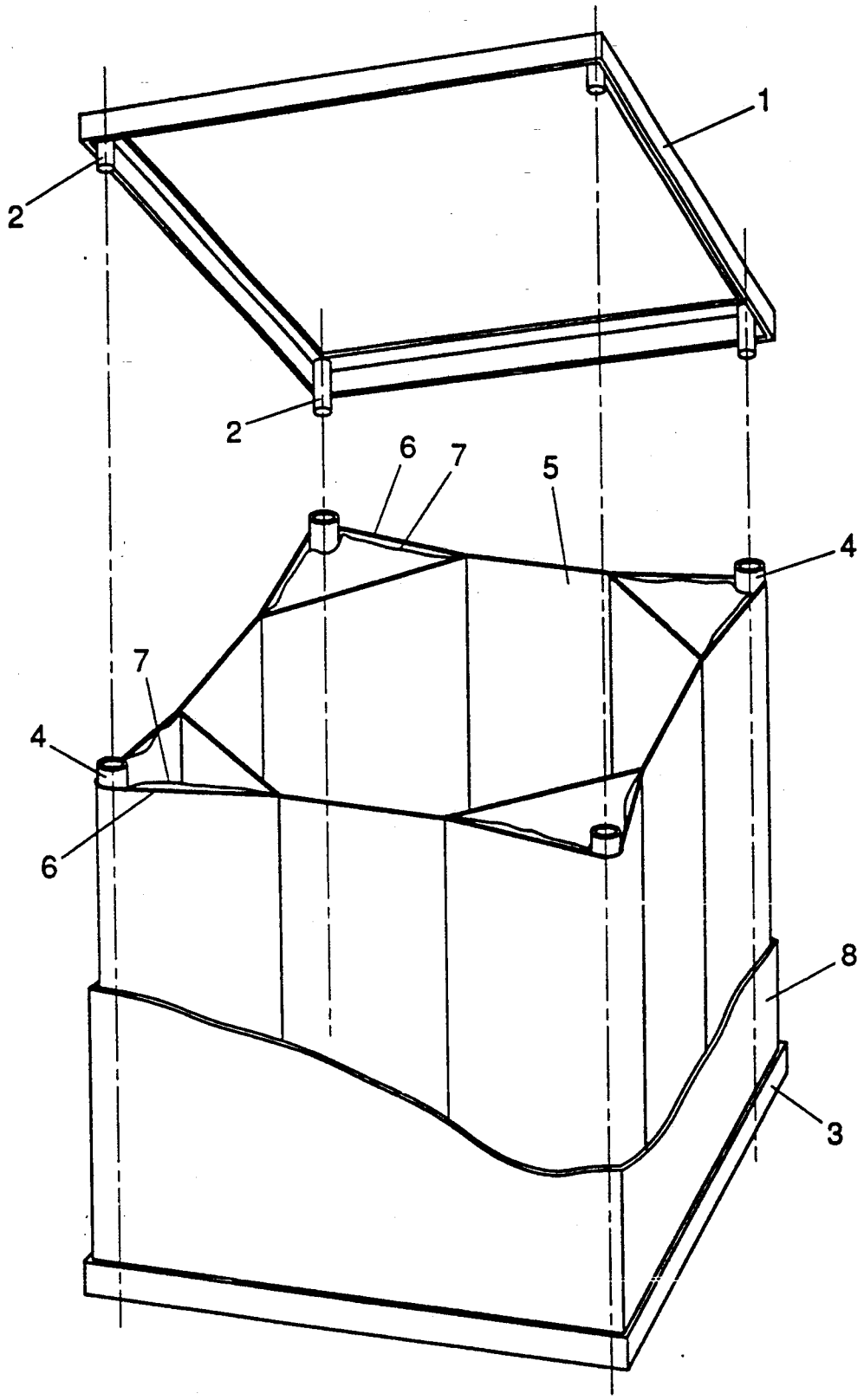
FIG. 1 is a perspective view of a first embodiment of the container, square in horizontal cross-section, with the cover member demounted from the remaining part of the container;.
Figure 2:
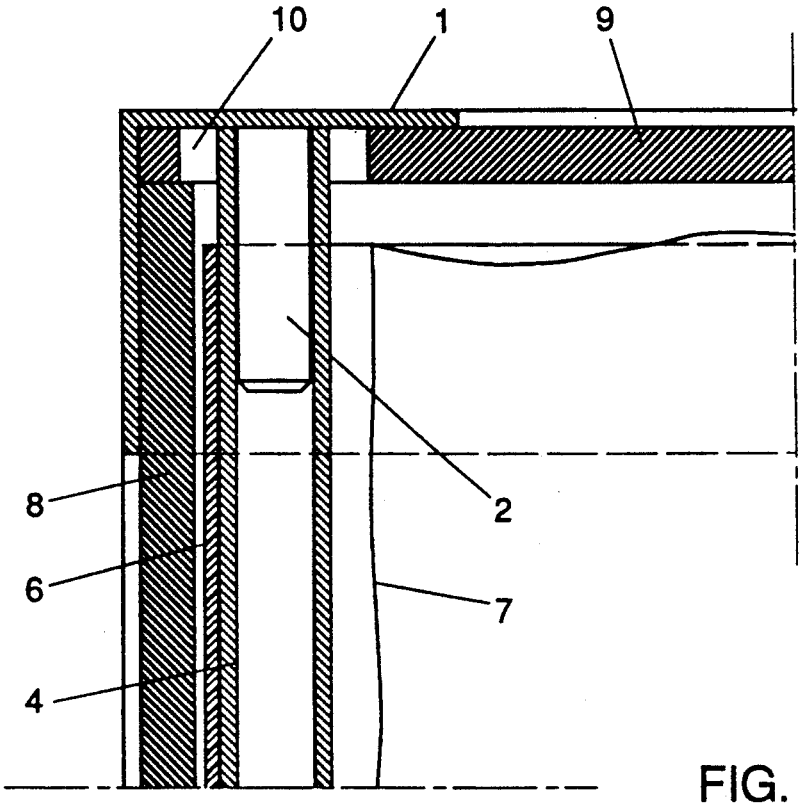
FIG. 2 is a detail of the container according to FIG. 1, with the cover member disposed in mounted position.

The container shown in FIG. 1 comprises a cover member 1 made up of four angle sections, interconnected for instance by welding. Mounted in each of the corner areas of the cover member 1 is a pin 2, which is so arranged that a free space remains between the depending flanges of the angle sections and the circumferential surface of each pin 2. The container further comprises a bottom member 3, which is identical to the cover member 1 in form and construction. Cooperating with each pin 2 and a corresponding pin of the bottom member 3 is a tubular element 4 having an inside diameter such that the pins can be slid into it, as will be seen most clearly in FIG. 2. Thus, a relatively stiff, form-retaining supporting frame is obtained.

Suspended within this supporting frame is the flexible interior of the container, which is composed of a shell member 5, four loop members 6 and four strip-shaped members 7. In the unfilled condition shown in FIG. 1, the shell member 5 has a cylindrical shape of octagonal cross-section. This shape is maintained by the four loop members 6, which have been folded over the tubular elements 4. As the shell member 5 is filled, it is deformed into a circle or an octagon with rounded corners, viewed in cross-section, whereby the loop members are subjected to additional stress so as to immovably fix the filled shell-shaped member within the supporting frame. For a further discussion of the mechanism at work here, reference is made to Dutch patent application 8801523.

As appears from FIG. 1, the prismatic corner areas defined by the loop members 6, which remain empty when the container is filled in the manner discussed above, occupy a substantial proportion of the space within the supporting frame. It is therefore preferred to fill these areas up. As noted before, the construction described sofar is intended to provide a stable, non-bulging container. It must therefore be attempted to prevent the container from bulging as a result of the areas outside the shell member 5 being filled up.

It has been found that the chosen construction, in which the filled shell member 5 is firmly retained in position by the loop members 6, at the same time constitutes a construction wherein the loop members 6 are tensioned to such an extent that they, too, can resist a certain load without essentially changing their shape. This is the basis underlying the insight that the prismatic corner areas can also be filled. In a number of cases, however, direct or indirect contact between the goods to be packaged and the tubular element 4 is undesirable or must be prevented.

If indirect contact is to be prevented, use can be made of the strip-shaped members 7 shown in FIG. 1, having a width of the order of magnitude of the width of the loop members 6, with the tubular element 4 extending between the loop member 6 and the strip-shaped member 7. In that case, the strip-shaped member 7 abuts the loop member 6, except at the location of a tubular element 5, which is screened and covered by the strip-shaped member 7. The prismatic spaces mentioned can therefore be filled up completely without the risk of direct contact between the packaged goods and the tubular element 4.

Figure 4:
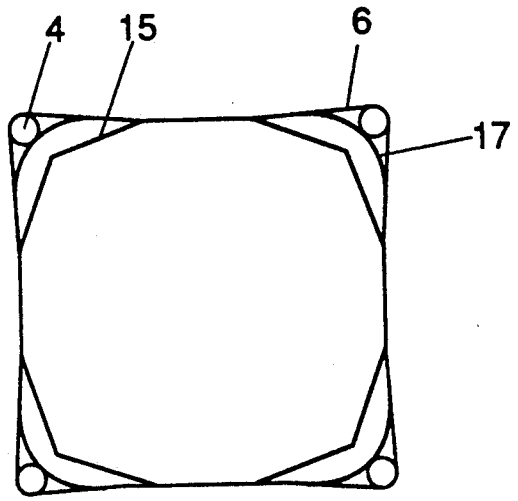
FIG. 4 is an alternative embodiment of the interior shown in FIG. 3.

If indirect contact between the packaged goods and the tubular element 4 is to be prevented as well, the solution shown in FIG. 4 can be opted for. The strip-shaped members 17 have a width such that they assume the shape of a circular cylindrical wall during filling, which in turn ensures a stable configuration. The mechanism involved is disclosed in European patent specification 247696.

It is further noted that FIG. 4 shows a shell member 15 of dodecagonal cross-section. With the choice of such a configuration, the form of a circle is approximated very closely. This greatly widens the variety of materials eligible for the manufacture of the container. Thus, it is also possible to choose materials of slighter flexibility than is desirable for the proper functioning of the octagonal configuration.

As noted, in the embodiment shown in FIG. 1, a space is present between the depending flanges of the cover member 1 and the pins 2. This space is necessary for allowing a loop member 6 to pass. At the same time, however, this space can be used for inserting a covering plate 8, forming a wall. It is possible to opt for four cover plates or for a covering shell having four wall surfaces. It will be clear that a cover plate can be provided with all kinds of imprints, lettered or otherwise. In this connection, it is further noted that if a covering plate 8 is made from a material having some flexibility, this plate can also be click-fitted into position after the container has been filled. As will appear from FIG. 2, it is also possible to arrange a cover plate 9 in the lid 1, this plate 9 being provided with local recesses 10 for allowing a pin 2 and a tubular member 4 to pass.

Figure 3:
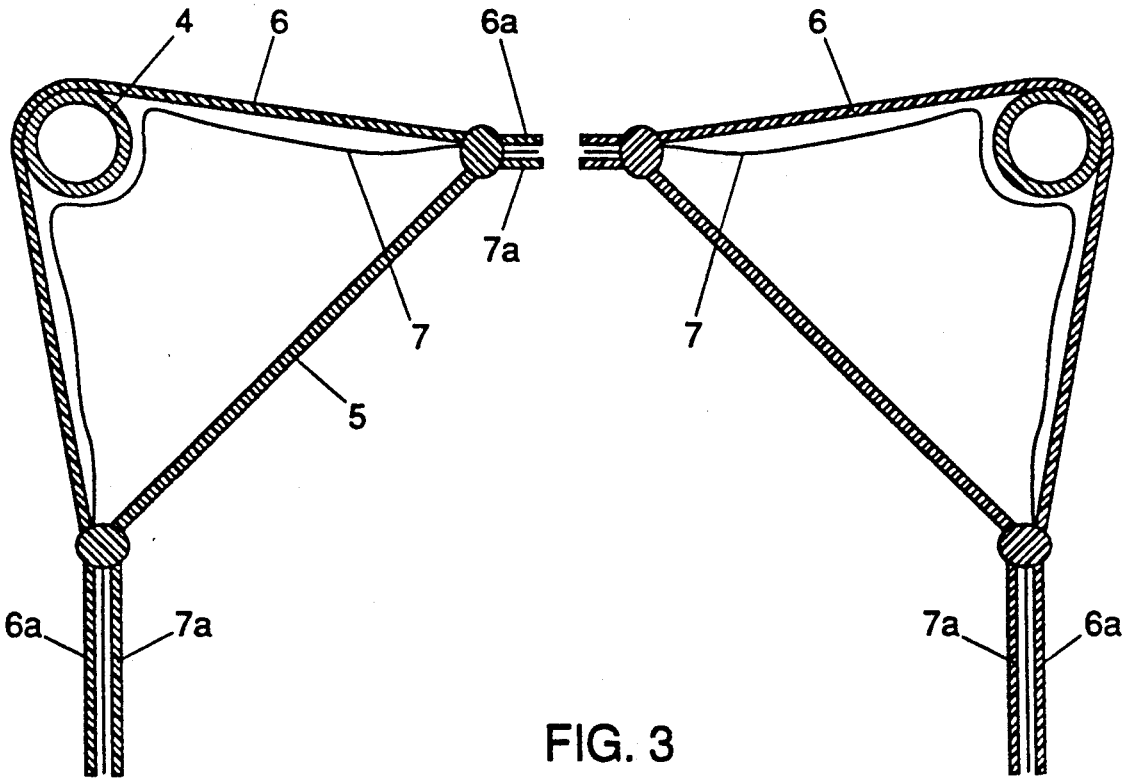
FIG. 3 is a possible embodiment of the interior of the container shown in FIG. 1.
Figure 3A:
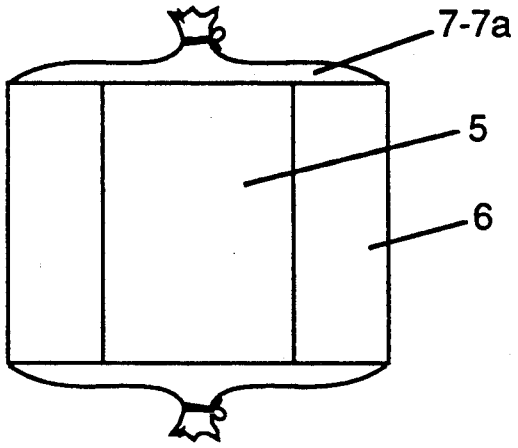
FIG. 3A shows a modification of the interior according to FIG. 3 with strip-shaped members closing off the interior.

In the foregoing, mention has been made of four loop members 6 and four strip-shaped members 7. As shown in FIG. 3, however, pairs of loop members 6 can be interconnected by a portion 6*a* and pairs of strip-shaped members 7 by a portion 7*a*. In that case, the interior of the container is formed by three tubular members: the shell member 5, the combined member 6–6*a* and the combined member 7–7*a*, with the portions 6*a* and 7*a* between the respective loop members 6 being in surface-to-surface contact with the corresponding portion of the shell member 5. If, in this embodiment, the combined member 7–7*a* is chosen to be considerably longer than the length of the tubular members, it will be clear, upon comparison with FIG. 1, that such an extended combined member 7–7*a* can be used for closing off the contents of the container from the environment as shown in FIG. 3A.

Figure 5:
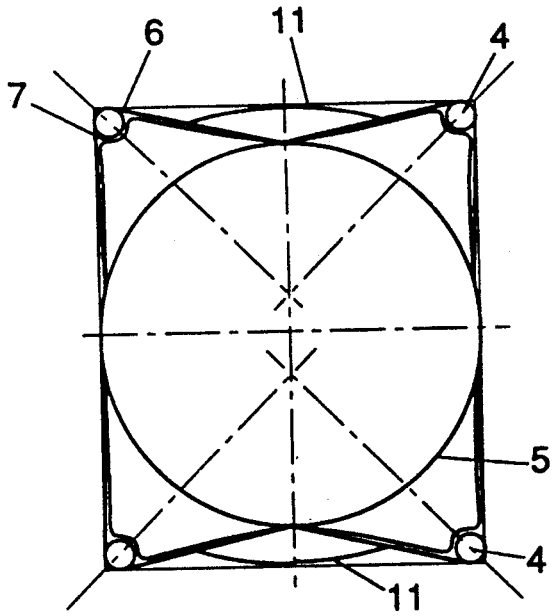
FIG. 5 is a first embodiment of the interior of a container, rectangular in horizontal cross-section.
Figure 6:
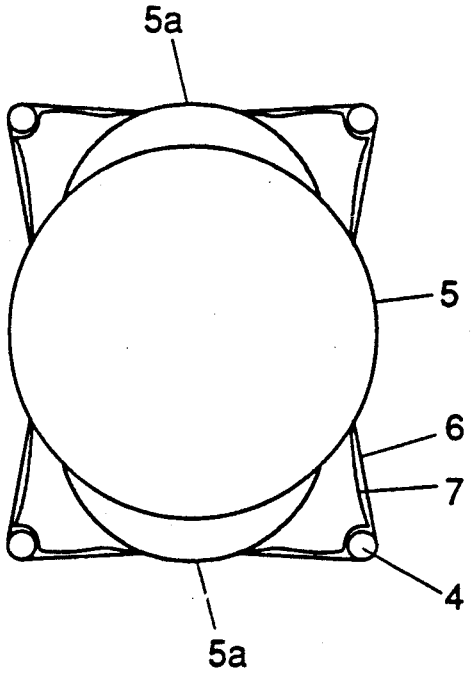
FIG. 6 is a second embodiment of the interior of a container, rectangular in horizontal cross-section.
Figure 7:
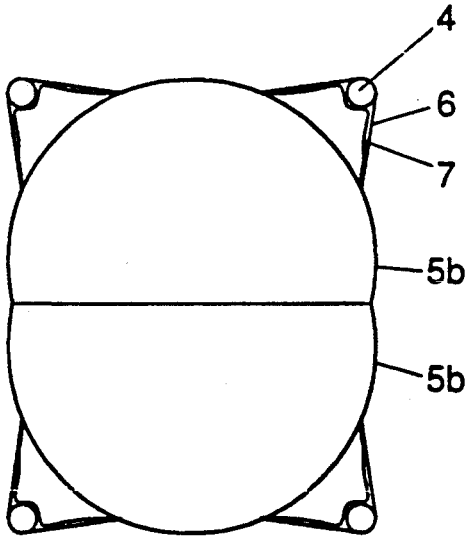
FIG. 7 is a third embodiment of the interior of a container, rectangular in horizontal cross-section.

The embodiments elucidated above were discussed with reference to containers of square configuration in horizontal cross-section. However, the present invention can equally well be used for containers of rectangular configuration in horizontal cross-section. FIGS. 5–7 show a number of examples. Further examples of rectangular container configurations are disclosed in Dutch patent application 9000552. In principle, the rectangular configuration is obtained by providing the circle which is the basic form for a square container, with further tubular members of crescent-shaped configuration in horizontal cross-section. These additional tubular members project in a first direction relative to the basic circle and, in a second direction perpendicular to the first direction, remain within the two tangent lines to the circle extending in this second direction.

In FIG. 5 four additional tubular members are used, formed by the loop members 6 to which, touching same, the strip-shaped members 7 are attached. With a view to using the space within the supporting frame as effectively as possible, it may be preferred to provide additional arcuate wall portions 11, yielding an additional compartment for accommodating material to be packaged. It is further noted that in this embodiment the strip-shaped members 7 are provided between the loop members 6 and the shell member 5.

FIG. 6 shows the basic form, the circular cylindrical shell member 5, extended to include two additional tubular members 5*a*, crescent-shaped in horizontal cross-section, which are arranged diametrically opposite each other. Again, as explained above, loop members 6 and strip-shaped members 7 are present.

In the embodiment according to FIG. 7, the shell member is composed of two identical tubular members 5*b* having the shape of a segment of a circle in horizontal cross-section, the members 5*b* having their flat walls attached to each other. Naturally, this can also be a single wall, which may or may not be provided with interruptions. As discussed above, here, too, loop members 6 and strip-shaped members 7 are present.

It will be clear that within the framework of the present invention, many modifications and variants are possible. The accompanying drawings only show a limited number of possible embodiments, while, moreover, numerous combinations of the drawings shown are possible. If so desired, the strip-shaped members shown in FIGS. 6 and 7 may also be shaped as shown in FIG. 4. It may further be observed that the various parts may each be made of any suitable material. For the interior parts, for instance, the following materials may be mentioned by way of example only: paper, cardboard, synthetic foil, strapped fabric, corrugated cardboard which may or may not be plasticized or otherwise treated to render it moisture-proof, while combinations of those materials are possible as well.

I claim:

1. A container comprising a relatively stiff, form-retaining supporting frame and a flexible shell member arranged therein, said shell member forming a receiving space for material to be packaged, said supporting frame comprising a polygonal bottom member and a correspondingly shaped polygonal cover member, both having corners, each corner of the bottom member being connected with a corner of the cover member by a rod-shaped element, the flexible shell member having a circumferential sidewall and being connected with each rod-shaped element by a respective flexible loop member, each loop member, starting from a first point of attachment to the shell member, said first point of attachment being on an exterior of the sidewall, passes around said rod-shaped element and extends further to a second point of attachment to the shell member on the exterior of the sidewall, spaced from the first point of attachment, each loop member having a length greater than a multiple of the circumference of the respective rod-shaped element, the loop members keep the shell member within outer boundaries of the supporting frame when the shell member contains material to be packaged, wherein a strip-shaped member made from a flexible material is connected with the shell member on the exterior of the sidewall and at a location proximate the points where the loop member is attached to the shell member, said strip-shaped member having a length at least equal to that of said rod-shaped element and a width greater than that of the shell member as measured between said two points of attachment, with the associated rod-shaped element extending between the loop member and the strip-shaped member.

2. A container according to claim 1, wherein the width of the strip-shaped member is equal to that of an arc of a circle which starts from said first point of attachment and touches the loop member, then extends towards and touches said rod-shaped element and extends towards said second point of attachment again touching the loop member.

3. A container according to claim 1, wherein the width of the strip-shaped member is substantially equal to that of the loop member.

4. A container according to claim 1, wherein the shell member, the loop members and the strip-shaped members are formed from three tubular parts, with wall portions of those tubular parts being in surface-to-surface contact with each other between a point of attachment of a first loop member and the adjacent point of attachment of a second loop member.

5. A container according to claim 4 wherein the tubular part that forms the strip-shaped members is so much longer than the rod-shaped elements, that said tubular part can serve for a bottom and cover closure for the packaged material.

6. A container according to claim 1, wherein the number of rod-shaped elements is four and said four rod shaped elements are arranged in a square configuration when viewed in cross-section.

7. A container according to claim 1, wherein the number of rod-shaped elements is four and said rod-shaped elements are arranged in the configuration of a rectangle when viewed in cross-section.

8. A container according to claim 7, wherein the shell member comprises a first central main compartment, which, in filled condition, has a circular cross-section of a diameter substantially equal to a width of the rectangle, as well as two subcompartments having a crescent-shaped cross-section in filled condition, said subcompartments being located diametrically opposite each other relative to the main compartment and giving the shell member a length substantially equal to a length of the rectangle, the loop members being attached to the main compartment at one point of attachment and to a subcompartment at another point of attachment.

9. A container according to claim 7, wherein the shell member comprises two equal compartments, each, in filled condition, having the shape of a portion of a circle, as viewed in cross-section, said compartments are attached to each other along a flat wall, with one set of two loop members being attached to one compartment and another set of two loop members being attached to the other compartment.

10. A container according to claim 7, wherein the shell member is filled condition defines central cylindrical main compartment having a circular cross-section of a diameter substantially equal to the width of the rectangle, and the four loop members in filled condition define four additional compartments, said rectangle surrounding and touching all four rod-shaped elements and said rectangle having a width equal to said diameter of the shell member and a length larger than said diameter of the shell member, said four additional compartments all having a horizontal cross-section within the virtual outer boundaries of said rectangle.

11. A container according to claim 1, wherein the cover member and the bottom member are each provided with a circumferential frame consisting of fixedly interconnected angle sections as well as coupling means for the rod-shaped elements, a space remains between the rod-shaped elements and the angle sections for inserting sidewall elements.

12. A container according to claim 11, wherein the rod-shaped elements consist of tubular elements and the coupling means consist of pins mounted on the cover and bottom members and said pins are capable of extending into the tubular elements.

* * * * *